US006605180B2

(12) United States Patent
Snekkenes et al.

(10) Patent No.: US 6,605,180 B2
(45) Date of Patent: Aug. 12, 2003

(54) PROCESS FOR CONTINUOUS COOKING OF PULP

(76) Inventors: Vidar Snekkenes, Herrhagsgatan 62, S-652 19 Karlstad (SE); Lennart Gustavsson, Renvallsvagen 38, S-653 50 Karlstad (SE); Sven-Erik Olsson, Hoglundagatan 41, S-686 31Sunne (SE)

( * ) Notice: Subject to any disclaimer, the term of this patent is extended or adjusted under 35 U.S.C. 154(b) by 0 days.

(21) Appl. No.: 09/967,346

(22) Filed: Sep. 28, 2001

(65) Prior Publication Data

US 2002/0079070 A1 Jun. 27, 2002

(30) Foreign Application Priority Data

Nov. 3, 2000 (SE) ..... 0004050

(51) Int. Cl.[7] ..... D21C 3/24; D21C 3/26; D21C 9/04; D21C 11/00

(52) U.S. Cl. ..... 162/17; 162/19; 162/29; 162/37; 162/40

(58) Field of Search ..... 162/60, 19, 17, 162/29, 30.1, 30.11, 47, 37, 39, 40

(56) References Cited

U.S. PATENT DOCUMENTS 3,303,088 A * 2/1967 Gessner ..... 162/60
4,975,148 A * 12/1990 Ryham ..... 162/60
5,066,362 A * 11/1991 Meredith ..... 162/19
5,203,963 A * 4/1993 Henricson ..... 162/19
6,030,492 A * 2/2000 Oulie et al. ..... 162/19
6,123,807 A * 9/2000 Engstrom et al. ..... 162/19

FOREIGN PATENT DOCUMENTS

WO 94-24362 * 10/1994 ..... 162/60

* cited by examiner

*Primary Examiner*—Steve Alvo
(74) *Attorney, Agent, or Firm*—Rolf Fasth; Fasth Law Offices

(57) ABSTRACT

Fiber material and cooking liquor are introduced at the top of the digester and pulp is discharged from the bottom of the digester, via a line in which the pulp is maintained at substantially the same pressure level, to a pressurized wash. More than 50% of the used cooking liquor (black liquor) which is extracted from the system in total is extracted from the wash filtrate of the pressurized wash. At the same time a small portion of the wash filtrate is also to be recirculated to the bottom of the digester as dilution liquid. The pressurized wash is regulated so that a high temperature is maintained in the wash filtrate. The extraction is regulated so that a net co-current flow is established at the bottom of the digester.

10 Claims, 1 Drawing Sheet

PROCESS FOR CONTINUOUS COOKING OF PULP

PRIOR APPLICATION

This application claims priority from Swedish Application No. 0004050-1, filed Nov. 3, 2000.

TECHNICAL FIELD

The invention relates to the continuous cooking of pulp.

BACKGROUND AND SUMMARY OF THE INVENTION

To increase the productivity in existing continuous pulp digesters, different modifications have successively been made to the cooking technique. When the production capacity is increased in the digester, the flow of pulp through the digester increases, whereupon the dwell time is reduced at the cooking temperature, which temperature is necessary to maintain sufficient release of the lignin and dissolution of the pulp chips.

A natural step has been to take the impregnation step from the digester itself and arrange it in a pretreatment vessel prior to the actual digester. In this way it is possible to maintain the dwell time for the pulp chips in the digester and the cooking temperature despite the speed of the flow of pulp through the digester increasing.

As production increases, it is also desirable that the main extraction screen for used cooking liquor, called black liquor, is moved down in the digester, so that the length of the cooking zone is extended. The main extraction screen for consumed cooking liquor draws off warm and pressurized black liquor, and steam is generated by the pressure of the black liquor first being released in a flash tank. The black liquor is then taken for evaporation after which it is conveyed onwards to the recovery arrangement (recovery boiler).

This involves a conflict with the demands on achieving an effective wash zone at the bottom of the digester, which wash zone is intended on the one hand to wash out residual lignin but also to have the effect of lowering the temperature of the pulp.

Lowering the temperature to below about 100 degrees has been considered necessary so that the strength of the pulp is not reduced. If the pulp at a temperature of over 100° C. is exposed to atmospheric pressure from the digester through a pressure-release delivery system, this results in blowing-off of heat, so-called flashing. If the temperature is substantially above 100° C. (near the cooking temperature of ~140–160° C.) and the pulp pressure is released to 1 bar, this results in very powerful flashing on account of the cooking liquor's conversion from liquid phase to steam phase, which greatly reduces the strength of the pulp.

To ensure a sufficient washing effect in the wash zone and a sufficiently low temperature in pulp blowing, the reduced length of the wash zone demands ever more powerful countercurrent flows of wash liquid in the wash zone. Particularly with increasing production in a given digester and with a constant dilution factor, the relative speed between liquor and chips increases, which results in increasing lift forces. This has a detrimental effect on the plug flow of pulp through the digester and tends to lift the whole pulp column in the digester, which effects both reduce the operability of the digester, with production shutdowns as a consequence.

U.S. Pat. No. 4,123,318 discloses a cooking system for pulp in which a specially adapted digester vessel is followed by two series-connected vessels for conventional countercurrent washing, i.e. the same type of washing as essentially always applies at the bottom of the digester.

EP-A-476,230 discloses a system in which a limited quantity of white liquor is added in the countercurrent zones during the extraction of consumed cooking liquor. Here, a heat exchanger is used for heating, in a recirculation loop above the bottom of the digester, the wash liquid delivered through the dilution nozzles. The pulp is fed to a diffuser which in normal circumstances is assumed to be an atmospheric diffuser, and where the wash liquid is assumed to be collected in a conventional manner from a downstream position in the fibre line. EP-A-476,230 states that the temperature in the countercurrent zones is increased to 140–175° C., in sample tests 165° C., and for a dwell time of 180 minutes. Here, full use has not been made of the fact that the dilution liquid/wash liquid added at the bottom of the digester will also already have this high temperature at the time of addition.

U.S. Pat. No. 5,066,362 discloses a digester and pressure diffuser system in which the pulp is taken from the bottom of the digester at temperatures of around 148–160° C. (300–320° F. in the text) and where the first stage of the pressure diffuser is provided with heated white liquor, expediently at the level of the blow temperature for the pulp. The aim here is to obtain an extended delignification of kraft pulp.

In a variant in said U.S. Pat. No. 5,066,362, only wash liquid from a subsequent drum wash is used, and at temperatures of around 74° C. (166 F. in the text) of the wash filtrate from the drum wash. Here, a countercurrent wash is established in a conventional manner at the bottom of the digester, where filtrate from the pressure diffuser is fed as wash liquid at the bottom of the digester and extracted via a screen arranged at a distance from the bottom of the digester. Thus, the wash liquid moves counter to the descending movement of the wood chips. The cooking liquor extracted from the screen is then led to a flash tank.

This document also includes extraction of some of the pressure diffuser filtrate to the flash tank, which sub-quantity only represents the excess which is not needed for the necessary amount of wash liquid in the wash zone. This system does not fully use the establishment of a co-current flow of cooking liquor and wood chips down through the whole digester, which impairs the operability particularly if production is to be increased as the flow speed of the wood chips has to be increased.

SE-C-501,848 (=EP 670,924; U.S. Pat. No. 5,919,337) has proposed a system in which a higher temperature can be maintained across substantially the whole of the digester, in so-called ITC cooking. This document has discussed the advantage of having the same pressure in the pulp flow's transfer to a so-called pressurized diffuser, which was at the bottom of the digester. The wash filtrate from the pressure diffuser is recirculated in full back to the bottom of the digester and has, upon recirculation, a temperature of 100° C., maximum 110° C., resulting in a wash zone/temperature-reducing zone at the bottom of the digester. Cooking liquor/wash liquid is extracted in a screen immediately above the bottom of the digester and is recirculated to this level via a heat exchanger so that the cooking temperature can be maintained over the lowest placed screen. The pulp issuing from the digester has a temperature of 105–115° C. Using the innovative solution of a pressure diffuser directly after the digester, which pressure diffuser is capable of working at digester pressure levels of 10–20 bar, there is no flashing directly after the digester. This eliminates the problems of blowing to atmospheric pressure from 105–115° C., which would cause an explosion-like disintegration of the pulp fibres.

In connection with special digesters for handling branch wood chips/sawmill chips, special problems arise when a very high degree of packing is obtained, which normally makes effective extraction of cooking liquor from the whole pulp column impossible using screens in the wall of the digester. The branch wood chips and sawmill chips represent raw materials with most of their content in fine fractions well below the normally well-defined wood chips for cooking.

Normal wood chips for cooking are obtained using chippers which give wood chips with lengths of about 20–25 mm.

The sawmill chip fraction is often defined as the fine fraction, or the material which passes through a sieve with round holes of about 3 mm.

The branch wood chip fraction is often defined as the intermediate fraction, or the material which passes through sieves with holes exceeding 3 mm but below 8 mm (where sawmill chips have already been sieved out) Thus, wood chips normally contain long slivers which can be allowed to pass through such a sieve.

The accepted part of the wood chips often has a content where the main part, more than 60%, often around 75–80%, consists of chips which pass through sieves with holes larger than 7 mm, but do not pass through sieves with 8 mm slits. Well-defined wood chips have most of their content within this range, and very small quantities of fine fractions.

When cooking branch wood chips/sawmill chips, use has previously been made of continuous digesters which are fed with wood chips and cooking liquid at the top, after which the pulp column is allowed to descend through the digester without extraction. In this particular context, pressure diffusers have been used as a wash connected directly after the cooking, and where the pressure diffuser has maintained the pressure from the digester. Here, the filtrate from the pressure diffuser has either been taken in its entirety for recovery and at high temperature, typically up to 150° C., or limited flows of about 25% have been returned to the digester outlet as dilution liquid, but then at temperatures of about 120° C. for the dilution liquid.

The invention relates to an improved process in which it is possible to increase production capacity, primarily in existing digesters for cooking of wood chips, but also in new installations, while maintaining a high degree of operability in a cooking process with a digester with an extended cooking zone without powerful countercurrent flows of cooking liquor or wash liquid in the digester and particularly at the bottom of the digester. By this means it is possible to obtain a stable and continuous column movement of the pulp volume down towards the bottom of the digester.

At the bottom of the digester there is a very high degree of packing, inter alia because of the fact that the chips are softened during the chemical dissolution process and the pressure from above chip column increases. If a countercurrent wash zone is to be located at the bottom of the digester, a bottom screen with a high extraction capacity has to be used in order to be able to establish an effective countercurrent which can give a washing out effect.

To be able to establish a net countercurrent flow overall, very large amounts of free liquid must be circulated, as it is necessary to compensate for the liquid which is bound in the chips and which is taken from the digester together with the chips. This is particularly noticeable in overloaded digesters where the speed of the chip column movement is very high.

If instead it is possible to accept that only the net flow of liquid at the bottom of the digester de facto moves downwards, a certain limited counterflow of free liquid can be allowed to move upwards. The wash effect from such limited countercurrent flows is however very limited. The problem of operability arises particularly in those cases where there is a powerful countercurrent flow of free liquid. By ensuring that the net flow of liquid at the bottom of the digester does not move upwards, in accordance with the invention, the operability of the digester is increased.

The definition of co-current zone thus signifies all zones where at least the net flow of the liquid has a movement which coincides with the descending movement of the chips. This means that in these zones the free liquid can still move upwards, but then with relatively limited amounts of liquid, which can be drawn off with a bottom screen even in the case of overloaded digesters.

In the most preferred embodiment of the invention, however, the digester is operated in such a way that the free liquid at the bottom of the digester also moves downwards.

Another object is to make it possible to minimize the extraction flows to be drawn off from the digester and then conveyed onwards to recovery (via blow tank evaporation and finally the recovery boiler). Major problems exist today in running overloaded digesters in particular, as relatively large extraction flows of consumed cooking liquor (black liquor) are to be obtained at typically just one single screen position far down in the digester, very near the lowermost wash zone screen. For reasons of flow technology, it is also often impossible in practice to draw off consumed cooking liquor at a speed higher than 0.03 m/s from the compressed pulp column, which means that it is impossible to draw off all the consumed cooking liquor from the entire cross section of the pulp column. At the same time it is difficult to draw off large amounts of consumed cooking liquor without disturbing/affecting the chip column movement.

Another object is to obtain a cooking zone which de facto uses the whole digester, and also to some extent continues after the digester, which means that the digester capacity can be increased even more, by increasing the flow speed of the pulp through the digester.

Another object is to move the main extraction of cooking liquor from the digester to an apparatus downstream of the digester, which apparatus is better suited to draw off the cooking liquor. In this way, the main extraction of consumed cooking liquor away from the process takes place not from an extraction screen arranged in the periphery of the digester, where the extraction is to draw off consumed cooking liquor from a pulp column with a diameter in the range of 5–12 meters.

A further object is to maintain a high temperature in the pulp, achieving improved heating economy, avoiding the heat losses which unavoidably occur in blowing of cooking liquor, and reheating of cooking liquors by means of indirect heat exchangers.

To avoid said disintegration of the digested pulp, which reduces its strength, the invention proposes that a pressurized wash apparatus be connected directly downstream of the digester and that the pulp be fed to this wash apparatus without any real decrease in pressure. A marked drop in pressure takes place only after the pressurized wash where the temperature of the pulp and its alkali content have dropped to such a level that the fall in pressure consequently has little or no negative effect on the quality of the pulp. Such a wash apparatus can advantageously consist of a pressure diffuser, also affording the advantage of being able to use the hot and pressurized extract from this pressure diffuser as dilution liquid at the bottom of the digester. This substantially improves the heating economy and at the same time results in reduced pump energy and reduces the need for cumbersome large heat exchangers.

DETAILED DESCRIPTION

Figure 1:
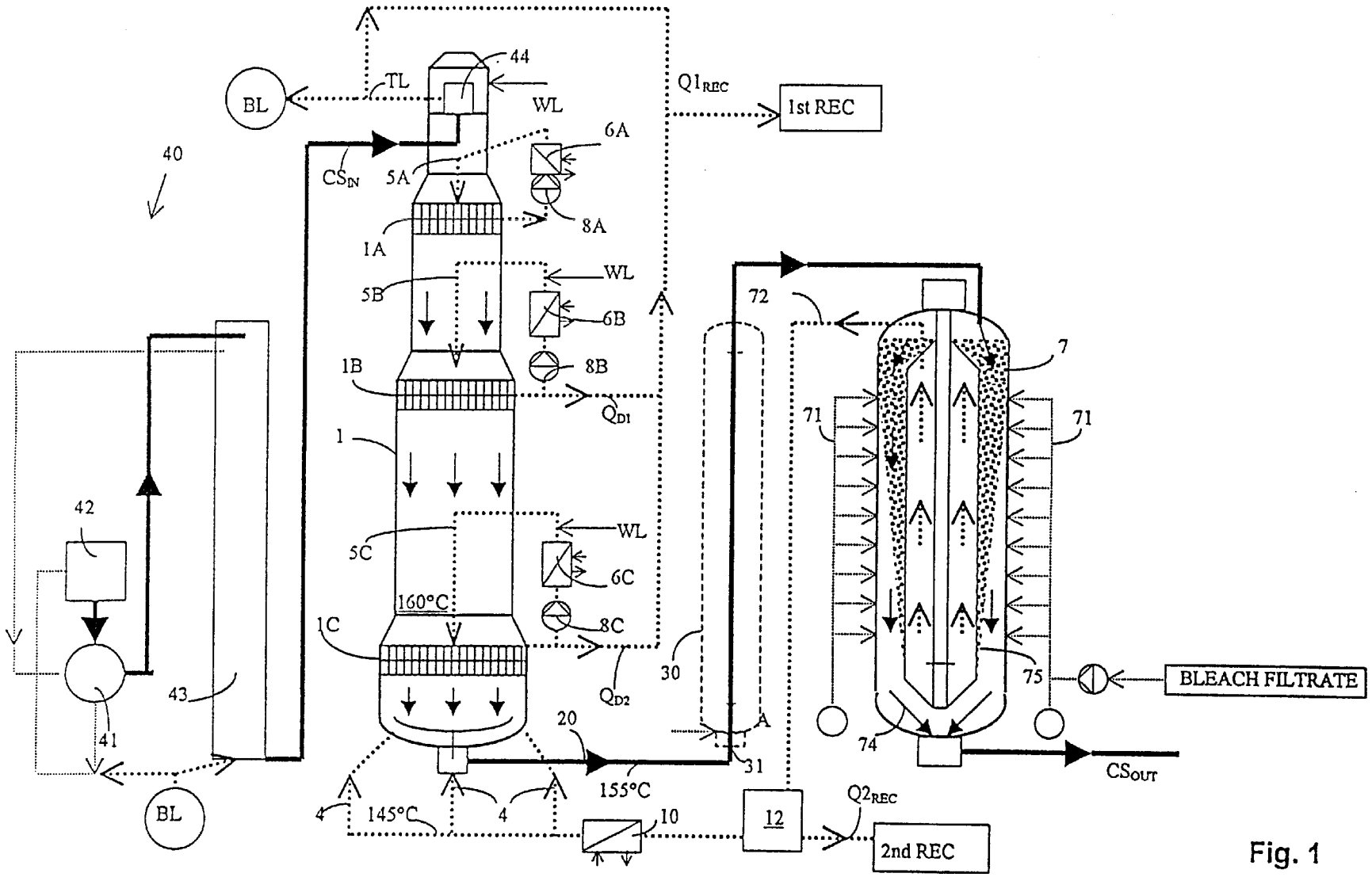
FIG. 1 shows a combination of a continuous digester with pretreatment system and a pressure diffuser which is operated using the process according to the invention.

FIG. 1 shows a digester 1 and a pressure diffuser 7 connected downstream. Wood chips are fed into the digester via a conventional pretreatment system 40 comprising a chip bin and steaming vessel 42 and a sluice 41. The pretreatment system can also comprise a pre-impregnation vessel (a black liquor impregnation vessel 43 is shown in the FIGURE). In a transport circulation, the chips are introduced $CS_{IN}$ into the top of the digester, where separation of transport liquid TL takes place in a top separator 44, which transport liquid here consists of black liquor BL.

The digester shown in the FIGURE is divided into four zones. The chip mixture $CS_{IN}$, which consists of a mixture of chips, moisture, condensate, white liquor, black liquor, is introduced at the top via an inverted top separator 44 where the transport liquid TL is separated from the chips.

The flow of the pulp/wood chips is indicated by solid arrows in the FIGURE.

A first zone is situated above the extraction screen 1A, in which upper zone the chips are impregnated with added white liquor WL and initially form the pulp column which later descends through the digester.

Second and third zones are situated between the extraction screens 1A and 1B and 1B and 1C, respectively, and finally there is a discharge zone under the extraction screen 1C.

In the embodiment shown, all the zones are so-called net co-current zones, which means that the net flow of liquid moves downwards in the same direction as the wood chips. However, these net co-current zones must at least extend over 80% of the height of the digester. In some cases it is also possible to use short countercurrent zones in the upper part of the digester, preferably within the upper ⅔ parts of the height of the digester, without negatively affecting the operability of the digester. These short countercurrent zones have an extent of less than 20%, and preferably less than 10%, of the height of the digester.

Short countercurrent zones early in the upper part of the digester do not appreciably affect operability as the wood chips have not reached the same degree of packing as at the bottom on account of the dissolving effect of the cooking on the chips.

In such a digester, the full cooking temperature is normally maintained in the co-current zones (i.e. about 142–162° C. for hard wood and about 162–168° C. for soft wood).

Dilution liquid is fed to the lower part of the digester through an inlet arrangement 4 mounted near the bottom of the digester. If appropriate, the dilution liquid can be added slightly further up in the digester, but the important feature of the invention is that at least the net flow of the liquid in the chip suspension after the addition of dilution liquid must move in a direction co-current with the chips. This dilution liquid consists mainly of used filtrate from a subsequent wash apparatus, here a pressure diffuser. In addition, the dilution liquid can be topped up (not shown) with fresh white liquor (alkali), or in the recirculation from the lower screen girdle (1C). The amount of dilution liquid is adjusted so that a suitable consistency is obtained for problem-free discharge and onward transport, suitably about 8–12%. The digested pulp is discharged via a line from the bottom of the digester.

In the digester shown, there are therefore no countercurrent wash zones (which conventionally are arranged in the lower region of the digester), which means that the chip column movement is improved and the flow through the digester can be increased, which entails an improved production capacity of the actual digester. According to the invention, however, short countercurrent zones can be arranged in the upper part of the digester, and in the lower part of the digester there are zones where the net flow of liquid flows downwards, the latter also involving weak countercurrent flows of free liquid.

A central pipe suspended in the digester 5C is fed from the lower screen arrangement 1C of the digester via a first pump 8C and heat exchanger 6C. The central pipe opens out level with the last-mentioned digester screen arrangement. The recirculation 1C-8C-6C-5C is used to regulate the temperature or the cooking liquor, where white liquor WL can be added.

A similar recirculation 1B-8B-6B-5B is arranged at the middle of the digester, and one 1A-8A-6A-5A at its uppermost part.

It can also be seen that, according to a preferred embodiment, a pressure diffuser 7 has been arranged alongside the digester 1. The pressure diffuser is a pressurized wash apparatus where the pulp from the digester is conveyed to one end of the pressure diffuser, after which pulp is conveyed through the diffuser in the form of a thin bed with a maximum thickness of 0.5 meter. The wash liquid 71 is introduced from one side of the pressure diffuser, from the outside, via a number of distribution rings arranged at different heights, so that a number of displacement zones are formed. The wash filtrate is displaced through the moving pulp bed and drawn off inwards through the wall 75 of the screen cylinder and collected on the other side, inside the screen cylinder for discharge at one end, at the top in the FIGURE. Wash liquid and filtrate flows indicated by broken arrows, and the pulp flow by a solid arrow. The FIGURE illustrates how the warm cooking liquor (indicated by dots) from the digester is displaced successively from the pulp by the wash liquid.

The pulp which is discharged at the bottom of the digester is fed via the line 20 without any real drop in pressure (preferably under 1 bar, for example about 0.5 bar) to said pressure diffuser 7, excluding differences in height. An important point here is that the drop in pressure must not be so great that cooking in the pulp is induced on account of the pressure drop. This means that in the pressure diffuser there will be a pressure corresponding to that in the digester, i.e. between 5–25 bar, normally 10–20 bar, in the bottom region depending on the height of the digester and the pressure applied at the top of the digester. Some of the liquid, the wash filtrate, extracted from the pressure diffuser is returned to the digester 1 via a line 72. In some cases it is advantageous to use a small heat exchanger 10 to further heat this liquid, which is added to the digester. The wash liquid 71

(expediently taken from a subsequent stage) passing into the pressure diffuser 7 should have a temperature well below +100° C., preferably +75° C.±15° C., in order to be able to obtain a pulp from the pressure diffuser 7, in the line 11, having a temperature below +100° C. (expediently with a consistency of about 10%). Thereafter, the pulp can be blown out to atmospheric pressure without the liquid being simultaneously evaporated, and the pulp quality is maintained at a high level.

In order to keep an advantageous heat and liquid balance, the pulp from the digester must keep a temperature exceeding +125° C., expediently a temperature between +125° C. and +175° C. A further aim is that the heating requirement in the lower zone (dilution zone) of the digester be reduced to a minimum. The liquid 72 extracted from the pressure diffuser should therefore retain a temperature not substantially below the cooking temperature in the digester by more than 25° C., preferably not below the cooking temperature by more than 20° C., and still more preferably by not more than 15° C. Lower temperature differences prevail at lower cooking temperatures, when using the same temperature of the wash liquid and the same dilution factor in the pressure diffuser.

An advantageous ratio between cooking temperature, discharge temperature and the temperature of the dilution liquid, in a system with a diffuser washer with dilution factor of about 2.5 and wash liquid with a temperature of about 70° C., is shown in the following table for different cooking temperatures:

| Cooking temp. ° C. | Discharge temp. ° C. | Dilution liquid temp. ° C. |
|---|---|---|
| 140 | 130 ± 5 | 125 ± 5 |
| 150 | 140 ± 5 | 135 ± 5 |
| 160 | 150 ± 5 | 145 ± 5 |
| 170 | 160 ± 5 | 150 ± 5 |
| 180 | 170 ± 5 | 160 ± 5 |

From the ratios shown it will be evident that the process is controlled in such a way that the temperature reduction from the cooking temperature obtained in the discharged pulp on account of the dilution is not higher than 20° C., preferably 15° C., and even more preferably as low as 5° C. The actual temperature reduction is strictly dependent on the dilution factor in the pressure diffuser and the temperature of the wash liquid in the pressure diffuser.

If one wishes to optimize the process further, two pressure diffusers can be arranged in series, and the first pressure diffuser is operated with dilution factor 0. It is possible then to minimize the temperature drop to individual degrees, where the dilution liquid temperature can correspond to the discharge temperature, which in turn means that the digester temperature can be maintained with a few degrees reduction through the first pressure diffuser.

If appropriate, it is also possible here to provide some degree of heating in a heat exchanger 10 in order to get this liquid up to optimum temperature, preferably about 145° C. at an average cooking temperature of 160° C. in the respective cooking zone, before it is fed to the lower part of the digester. As has already been mentioned, +155° C. (principally for hard wood) is a preferred temperature level, but other temperatures of between +150° C. and +165° C. are also possible, even though, for reasons of heat economy among other things, temperatures under +160° C. are to be preferred.

In the case described, wash liquid at about 70° C. is used in the pressure diffuser. A buffer 12 can advantageously be used between the pressure diffuser 7 and the digester 1 for extraction from the dilution liquid to these two units. Such a buffer 12 must therefore be pressurized.

According to an important aspect of the invention, a limited extraction of used cooking liquor from the digester and away from the cooking process takes place via at least one digester screen arrangement 1A, 1B, 1C, or alternatively from the top separator 44. This limited extraction takes place at a suitable position between the pretreatment system 40 and the bottom of the digester, and conveyed onwards for recovery $1^{st}$ REC, where this quantity represents a first quantity of used cooking liquor $Q1_{REC}$. This limited quantity can also consist of or be completely replaced by a quantity which is taken from a pre-impregnation vessel in the pretreatment system 40 or from the transfer system of chips from a pre-impregnation vessel to the digester.

A first portion of the wash liquid filtrate $Q2_{REC}$ is extracted from the cooking process and conveyed onwards for recovery at $2^{nd}$ REC, where this quantity represents a second quantity of used cooking liquor ($Q2_{REC}$) and which together with the first quantity of used cooking liquor $Q1_{REC}$ represents the total quantity extracted from the system with digester and pressurized wash.

The total quantity of used cooking liquor extracted from the digester and pressurized wash system corresponds to $Q1_{REC}+Q2_{REC}$. The ratio of the first quantity of used cooking liquor $Q1_{REC}$ to the second quantity of used cooking liquor $Q2_{REC}$ is regulated such that $$Q1_{REC}>0.1.(Q1_{REC+Q2REC})$$

$$Q2_{REC}<0.9.(Q1_{rec+Q2REC}), \text{ and}$$

$$Q2_{REC}>Q1_{REC}$$

In this way, at least 50% and at most 90% of the extraction of used cooking liquor will take place in the pressurized wash, where the washing capacity is much more favourable than in the digester, especially if the latter is overloaded.

According to an alternative process, it is possible to arrange, between the digester and the pressure diffuser, a further pressure vessel 30, indicated by broken lines in FIG. 1, in which vessel a further delignification takes place. By using a vessel where the pulp flows upwards, so-called ascending flow vessel, a very favourable process is obtained in which it is possible to utilize the pressure from the digester in order to drive the pulp through the pressure vessel 30. Further alkali can be added preferably together with the dilution liquid at the bottom of the digester, alternatively in the outlet from the digester or at the bottom of the vessel, in some form of cooking arrangement 31 (for example an MC mixer) so that the newly added cooking liquor is distributed well in the chip bed. According to this alternative way of implementing the invention, a pressure-increasing mixer can be used which to some extent can compensate for pressure losses in the transfer between digester and pressurized wash. The total pressure drop in the transfer should be as small as possible, i.e. preferably under 1 bar, excluding differences in static pressure (structural height).

The invention is not limited by what has been indicated above and instead can be varied within the scope of the attached patent claims.

A digester of the so-called hydraulic type, with a lower temperature in the upper part (impregnation zone), can also advantageously be arranged according to the invention.

The method can further be used in connection with all types of cooking liquor, although the method is principally intended for production of sulphate pulp.

The number of recirculation flows can be more or fewer than is shown in FIG. 1. Likewise, the number of extraction positions in the digester, where cooking liquor extractions QD2 or QD1 are recovered, can be just one, preferably far down in the digester.

The pressurized wash apparatus can also be of a type other than a pressurized wash, for example pressurized wash presses, filters or the like where the pulp is exposed to the displacement effect with the wash liquid and a wash filtrate is obtained mainly containing original cooking liquor, at least 80% of original cooking liquor, from the digester. Another alternative is a pressurized press, followed by dilution, where the press filtrate forms the dilution liquid used for the digester.

It is also possible to arrange two pressurized wash apparatuses in series, if appropriate two pressure diffusers in series.

Different types of easy defibering effects can be introduced into the system for the purpose of replacing the defibering effect which can be obtained via blowing of the pulp to atmospheric pressure. This defibering effect can be obtained in a conventional manner by some type of tramp material separator in the transfer line 20 from the bottom of the digester. These tramp material separators comprise a rotary separator which gives the pulp a light defibering effect. Corresponding light defibering can also be set up in the line leading out from the pressure diffuser $CS_{OUT}$.

The invention can also be used in cooking systems with black liquor impregnation in a vessel preceding the digester, and where for example the used black liquor is first utilized in a black liquor impregnation step before it is extracted from there and is only then sent for recovery. The principle of the invention is that most, 50–90%, of what is extracted from the digester and wash system is from the wash filtrate obtained from the pressurized wash.

While the present invention has been described in accordance with preferred compositions and embodiments, it is to be understood that certain substitutions and alterations may be made thereto without departing from the spirit and scope of the following claims.

What is claimed is:

1. A process for a continuous cooking of wood chips at elevated pressure and temperature in a vertical digester for production of chemically dissolved pulp, comprising:

providing the digester with a top and a bottom and a digester screen arrangement disposed between the top and the bottom;

introducing the wood chips and a cooking liquor at the top of the digester to form a pulp slurry;

maintaining a mean cooking temperature in a cooking zone at a temperature between 140° C. and 180° C.;

extracting used cooking liquor from the cooking zone of the digester by using the digester screen arrangement;

conveying a first quantity (Q1) of the extracted used cooking liquor to a recovery unit for liquor recovery;

establishing a net co-current flow of liquid at the bottom of the digester;

discharging the pulp slurry from the bottom of the digester into a line at a temperature that is not more than 20° C. below the cooking temperature in the cooking zone;

feeding the pulp slurry in the line, at a pressure level that does not induce cooking of the pulp slurry, to a pressure diffuser;

feeding a wash liquid into the pressure diffuser;

withdrawing at least a portion of a used cooking liquor from the pulp slurry to an inside chamber defined in the pressure diffuser by using the wash liquid to displace the used cooking liquor in the pulp slurry to obtain a wash filtrate;

in a buffer, extracting used cooking liquor from the wash filtrate and conveying a second quantity (Q2) of the used cooking liquor extracted from the wash filtrate to the recovery unit for liquor recovery, the first quantity (Q1) and the second quantity (Q2) representing a total quantity of used cooking liquor extracted from the process;

conveying a first portion of the wash filtrate back to the bottom of the digester; and regulating a ratio of between the first quantity (Q1) and the second quantity (Q2) of the used cooking liquor so that (Q2)>(Q1).

2. The process according to claim 1 wherein the step of establishing at the net co-current flow segment comprises physically extending the net co-current flow segment from the bottom of the digester to an extraction screen disposed in the digester.

3. The process according to claim 1 wherein the method further comprises establishing a net co-current flow segment through essentially the entire digester.

4. The process according to claim 1 wherein the method further comprises establishing a net co-current flow that extends over at least 80% of a height of the digester.

5. The process according to claim 1 wherein the method further comprises establishing a short net co-current flow segment that extends over less than 80% of a height of the digester and the short net co-current flow segment is disposed at an upper part of the digester.

6. The process according to claim 5 wherein the method further comprises arranging the short net co-current flow segment within an upper two thirds of a height of the digester.

7. The process according to claim 1 wherein the method further comprises providing a net co-current flow with a sufficient flow to establish a net co-current flow of the liquid disposed at the bottom of the digester.

8. The process according to claim 1 wherein the method further comprises maintaining the mean cooking temperature in the cooking zone at a temperature between 150° C. and 155° C. when hard wood is used.

9. The process according to claim 1 wherein the method further comprises maintaining the mean cooking temperature in the cooking zone at a temperature between 150° C. and 155° C. when soft wood is used.

10. The process according to claim 1 wherein the method further comprises maintaining mean cooking temperature for a wood chip dwell time of at least 120 minutes.

* * * * *